US005339480A

United States Patent [19]

Murg et al.

[11] Patent Number: 5,339,480

[45] Date of Patent: Aug. 23, 1994

[54] TINT BOTTLE AND NOZZLE CLEANING BRUSH

[76] Inventors: Sandra D. Murg, 9281 Tritt Cir., Villa Park, Calif. 92667; John S. Gerling, 4152 Paloverde, Lakewood, Calif. 90713

[21] Appl. No.: 96,295

[22] Filed: Jul. 26, 1993

[51] Int. Cl.[5] ..... A46B 5/02; A46B 9/00

[52] U.S. Cl. ..... 15/106; 15/160; 15/164; 15/206; 15/DIG. 5

[58] Field of Search ..... 15/104.05, 104.16, 104.2, 15/106, 164, 159.1, 206, 207.2, DIG. 5; D4/105, 106, 116, 118, 119, 120, 131

[56] References Cited

U.S. PATENT DOCUMENTS

| | | | |
|---|---|---|---|
| D. 95,319 | 4/1935 | Eaton | D4/119 |
| D. 247,076 | 1/1978 | MacCollum | D4/119 |
| D. 250,068 | 10/1978 | Ducotey | D4/119 |
| D. 331,150 | 11/1992 | Hartel | D4/131 |
| 1,254,217 | 1/1918 | Drummond | 15/106 |
| 1,967,597 | 7/1934 | Schwartz | 15/206 |
| 3,451,723 | 6/1969 | Marks | 15/164 |
| 5,038,509 | 8/1991 | Stephan | 15/104.16 |

FOREIGN PATENT DOCUMENTS

| | | | |
|---|---|---|---|
| 0511842 | 11/1992 | European Pat. Off. | 15/160 |
| 418631 | 10/1910 | France | 15/164 |
| 42469 | 2/1926 | Norway | 15/160 |
| 48818 | 7/1909 | Switzerland | 15/160 |
| 9009 | of 1897 | United Kingdom | 15/206 |
| 17198 | of 1897 | United Kingdom | 15/206 |
| 320949 | 10/1929 | United Kingdom | 15/206 |

OTHER PUBLICATIONS

"Agriculture and Dairy Farming" Article (Brushes, Apr. 1954, vol. 40 #472, pp. 18–19.

*Primary Examiner*—Timothy F. Simone
*Assistant Examiner*—Randall E. Chin
*Attorney, Agent, or Firm*—Roy A. Ekstrand

[57] ABSTRACT

A cleaning brush includes an elongated handle having opposed ends and a handle shape for use as a manual cleaning brush. A primary wire stem extends outwardly from one end of the handle and supports a primary bristle array having a generally cylindrical shape portion terminating in an outwardly extending domed portion. A secondary wire stem extends oppositely from the primary wire stem outwardly from the opposite end of the handle and supports a secondary bristle array. The secondary bristle array defines a cylindrical bristle portion proximate the handle end and a tapered bristle portion extending beyond the cylindrical bristle portion. The secondary bristle array is configured to correspond to the interior of a typical tint bottle nozzle cap while the primary bristle array is configured to correspond to the interior of a typical tint bottle.

7 Claims, 1 Drawing Sheet

TINT BOTTLE AND NOZZLE CLEANING BRUSH

BACKGROUND OF THE INVENTION

Field of the Invention

This invention relates generally to cleaning brushes and particularly to cleaning brushes utilized in cleaning specialized tint bottles.

In hairstyling salons and similar facilities, clients often desire to obtain a hair color change or color tint. In some coloring and tinting procedures, portions of the client's hair are treated while other portions of the client's hair are not. To accomplish this localized tinting or hair coloring, practitioners in the art utilize small product applicators known generally in the art as "tint bottles". In their most common form, these tint bottles comprise generally cylindrical resilient plastic bottles having a narrowed neck portion upon which a combination nozzle and cap also usually formed of a molded plastic material is received in a threaded engagement. In the most common types of tint bottles, the nozzle cap defines a tapered nozzle having a tapered passage therein which terminates in a relatively small almost pointed tip having a small discharge aperture therein.

In most instances, the tint bottles are reused on successive clients and must therefore be cleaned between uses to remove the residue of tint or dye within the bottle and nozzle to avoid contamination of hair coloring or tint used on subsequent clients. Unfortunately, the tint or dye materials used in such processes are extremely difficult to remove during the cleaning operation of the tint bottles following use. In most instances, practitioners are encouraged to place the tint bottles within a cleaning solution bath or soaking following use and thereafter to thoroughly wash and clean the tint bottles. In many instances, however, the tint bottles are not properly soaked or processed after use. In many hairstyling salons as a result, a quantity of tint bottles requiring cleaning accumulates within the salon cleaning facility making the tint bottle cleaning process more difficult.

Thus, despite the pervasive use of such tint bottles, an effective easy and reliable cleaning system for such bottles has yet to be found. As a result, such bottles are often discarded prematurely due to the excessive work required to clean the bottles.

There remains, therefore, a need in the art for an improved apparatus for cleaning such tint bottles which is specifically directed to the problems associated with cleaning tint bottles.

SUMMARY OF THE INVENTION

Accordingly, it is a general object of the present invention to provide an improved tint bottle cleaning apparatus. It is a more particular object of the present invention to provide a tint bottle cleaning brush which readily cleans the tint bottle and nozzle cap in an easy and efficient manner.

In accordance with the present invention, there is provided for use in cleaning a tint bottle having a generally cylindrical bottle and a tapered nozzle cap, a tint bottle brush comprises: an elongated handle defining an elongated handle body having a major axis and opposed first and second ends; a primary wire stem secured to the first end and extending outwardly therefrom in alignment with the handle major axis; a primary bristle array supported by the primary wire stem forming a first generally cylindrical bristle portion; a secondary wire stem secured to the second end and extending outwardly therefrom in alignment with the handle major axis; and a secondary bristle array supported by the secondary wire stem forming a second generally cylindrical bristle portion proximate the second end and a tapered generally conical portion extending beyond the second generally cylindrical bristle array.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
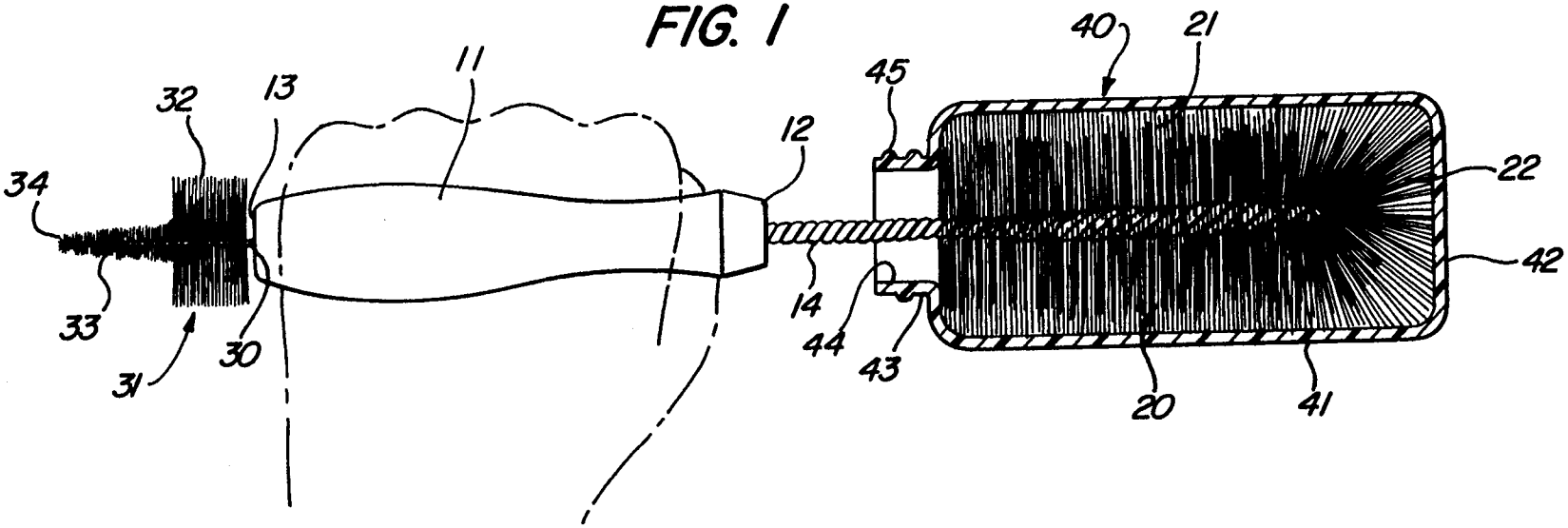
FIG. 1 sets forth a section view of the present invention cleaning brush used in cleaning a typical tint bottle.

FIG. 1 sets forth a section view of a tint bottle brush constructed in accordance with the present invention and generally referenced by numeral 10. Brush 10 includes an elongated handle 11 having end portions 12 and 13 and a generally circular cross-section curved shape extending therebetween. Handle 11 is preferably formed of a lightweight rigid material such as wood or molded plastic or the like. An elongated primary wire stem 14 is received within handle 11 and extends outwardly from end 12. Wire stem 14 comprises a plurality of metal wires wound in accordance with conventional brush fabrication techniques to secure and support a plurality of resilient bristles forming a primary bristle array 20. Bristle array 20 is preferably formed to define an elongated cylindrical bristle portion 21 having a domed or spherical portion 22 at the extreme end thereof.

A secondary bristle array 31 is formed by a secondary wire stem 30 received within and secured to handle 11 and extending outwardly from end 13 thereof. Secondary wire stem 30 extends diametrically opposite and generally aligned with primary wire stem 14. A secondary bristle array 31 is formed of a plurality of resilient bristles forming a cylindrical portion 32 and a tapered portion 33. Tapered portion 33 terminates in an end 34. Secondary wire stem 30 is formed of a plurality of metal wires wound to captivate secondary bristle array 31 in accordance with conventional bristle fabrication techniques.

In accordance with the present invention, primary bristle array 20 and secondary bristle array 31 extend diametrically opposite with respect to handle 11 and thus facilitate the cleaning of tint bottles. Of particular advantage in the present invention bottle brush is the placement of particularly adapted bristles arrays for completely cleaning the tint bottles in the opposed in-line structure with respect to handle 11 which maintains each bristle array in a convenient out of the way but nonetheless accessible position during periods of nonuse while the other bristle array is being used. For example, as seen in FIG. 1, brush 10 is shown being used to clean the bottle portion of a conventional tint bottle 40. Tint bottle 40 is constructed in accordance with conventional fabrication techniques and is preferably formed of a molded plastic material or the like. The shape of tint bottle 40 is typical of such tint bottles and includes a cylindrical side wall 41, a closed bottom portion 42 and a neck 43. The latter supports a plurality of threads 45 and defines a neck passage 44. In the anticipated use of the present invention tint bottle brush, primary bristle array 20 is forced through neck passage 44 of tint bottle 40 and due to the resilience of bristle array 20 is able to pass through the narrowed portion of neck passage 44 and expand into the cylindrical portion of side wall 41. The length and diameter of cylindrical portion 21 and domed portion 22 is selected to correspond closely with the interior portion of a conventional tint bottle such as tint bottle 40.

It should be noted that as the user manipulates handle 11 to move primary bristle array 20 within tint bottle 40 in the cleaning operation, secondary bristle array 31 is maintained in a convenient but removed position due to the in-line arrangement of oppositely posed bristle arrays 20 and 31. It should also be noted that the provision of primary and secondary bristle arrays secured to handle 11 in accordance with the present invention provides a convenient single brush tool configured specifically to meet the needs of cleaning tint bottle brushes.

Figure 2:
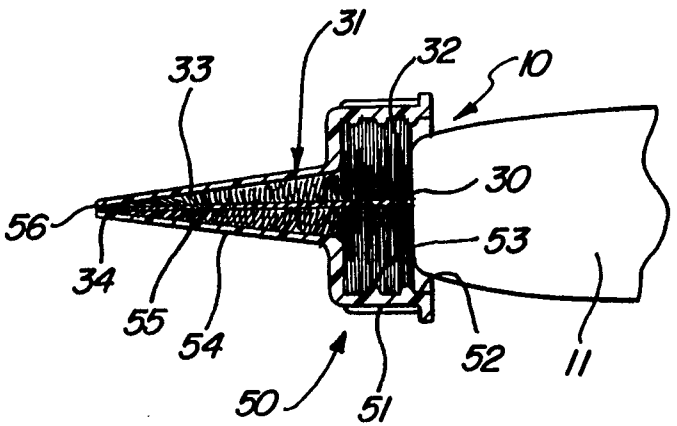
FIG. 2 sets forth a section view of the present invention cleaning brush in operation to clean a small sized tint bottle nozzle and cap.

FIG. 2 sets forth a partial section view of brush 10 utilized in applying secondary bristle array 31 to a typical tint bottle nozzle cap generally referenced by numeral 50. In accordance with conventional fabrication techniques, nozzle cap 50 includes a generally cylindrical cap portion 51 defining a neck chamber 52 within which a plurality of threads 53 are supported. With temporary reference to FIG. 1, it should be noted that the assembly of tint bottle 40 is completed by threading cap portion 51 upon neck 43 such that threads 53 and 45 are mated to secure nozzle cap 50 to tint bottle 40 in its anticipated use.

Returning to FIG. 2, nozzle cap 50 further includes a tapered nozzle 54 defining a tapered nozzle passage 55 terminating in a tip aperture 56.

In accordance with the present invention, brush 10 is conveniently used to clean nozzle cap 50 by inserting secondary bristle array 31 into the interior of nozzle cap 50. It should be noted that tapered portion 33 and end 34 of secondary bristle array 31 are configured to closely correspond to the interior of nozzle cap 50. In addition, cylindrical portion 32 of bristle array 31 is resiliently received within neck chamber 52 of nozzle cap 50 to provide optimum cleaning action for the rather peculiar shape of nozzle cap 50. Once again, handle 11 is manipulated to provide movement of secondary bristle array 31 within nozzle cap 50 to complete the cleaning of nozzle cap 50. With temporary reference once again to FIG. 1, it should be noted that as the user employs secondary bristle array 31 to clean nozzle cap 50, primary bristle array 20 is maintained in a removed noninterfering position from the cleaning operation.

Thus, the combination of handle 11 and oppositely posed extending bristle arrays 20 and 31 provides a convenient cleaning tool which conveniently maintains both bristle arrays in a ready to use configuration without the need of multiple brushes or movable parts. The diametrically opposed position of wire stems 14 and 30 for primary bristle array 20 and secondary bristle array 31 respectively further protects the user against inadvertent injury as brush 10 is being manipulated within a cleaning solution such as soapy water or other cleaning baths.

It will be apparent to those skilled in the art that bottle brush 10 is preferably sized and configured to suit the needs of the highly specialized operation of cleaning tint bottles frequently undertaken in hairstyling salons or similar facilities. Thus, the cylindrical shape with domed bottom portion of primary bristle array 20 is specifically configured and sized to be utilized in the cleaning of a typical tint bottle 40. Similarly, secondary bristle array 31 is, in its preferred form, very specifically shaped and sized to correspond to the nozzle cap such as typical nozzle cap 50 in its intended cleaning use. Thus, secondary bristle array 31 is, in essence, a compound bristle array having a cylindrical portion 32 corresponding to the cap portion of the nozzle cap and a tapered portion 33 corresponding to the tapered nozzle of a typical nozzle cap such as nozzle cap 50. The diametrically opposed positioning of wire stems 14 and 30 permits the safe use of extremely stiff effective wire stems without compromising safety and ease of use.

It will be apparent to those skilled in the art that while tint bottle 40 is illustrative of one size of commonly used tint bottles, tint bottles are also frequently utilized in a somewhat larger size having a shape generally corresponding to tint bottle 40. Commonly in such larger tint bottle sizes, the nozzle cap portion is configured in a somewhat different geometric proportion to facilitate and accommodate the larger tint bottle size.

Figure 3:
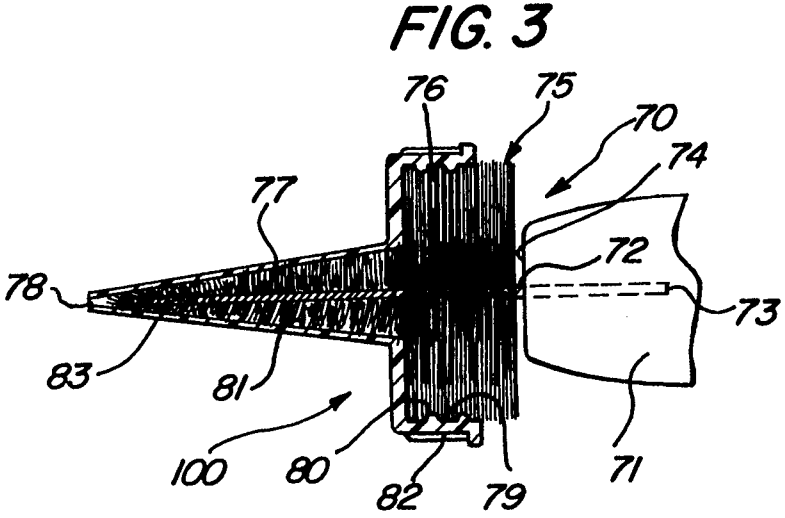
FIG. 3 sets forth a section view of an alternate embodiment of the present invention cleaning brush configured to clean a large size tint bottle cap and nozzle.

FIG. 3 sets forth an alternate embodiment of the present invention brush generally referenced by numeral 70 shown cleaning a typical larger size nozzle cap generally referenced by numeral 100. Nozzle cap 100 conforms generally to nozzle cap 50 shown in FIG. 2 with the exception that nozzle cap 100 defines a larger cap portion 82 defining a neck passage 79 and a plurality of internal threads 80. Cap portion 82 is substantially larger in diameter with respect to the size of tapered nozzle 83. Tapered nozzle 83 defines a tapered nozzle passage 81 terminating in a tip aperture 78 generally similar to that shown for nozzle cap 50 in FIG. 2.

In accordance with the present invention, bottle brush 70 includes a handle 71 generally corresponding to handle 11 in the embodiment shown in FIGS. 1 and 2 within which an elongated secondary wire stem 72 is supported. Secondary wire stem 72 comprises a plurality of metal wires wound in accordance with conventional brush fabrication techniques and defines an interior end 73 received within handle 71. End 73 is preferably secured within handle 71 using conventional attachment techniques, such as being molded in, in the event handle 71 is fabricated of a molded plastic material or received within a suitable elongated closed end passage formed within handle 71 in the event a wooden handle or the like is used. The important aspect of secondary wire stem 72 is to provide a secure attachment to handle 71 while extending outwardly to support secondary bristle array 75. In correspondence to the shape of nozzle cap 100, secondary bristle array 75 includes a cylindrical portion 76 and a tapered portion 77.

While not seen in FIG. 3, it should be understood by those skilled in the art that brush 70 is similar to brush 10 shown in FIG. 1 in that handle 71 defines an opposite end similar to end 12 of handle 11 and a primary bristle array having a generally cylindrical shape corresponding to primary bristle array 20. Thus, the descriptions set forth above in FIG. 1 of brush 10 dealing with primary bristle array 20, wire stem 14 and end 12 of handle 11 should be understood to apply equally well to the alternate embodiment brush referenced by numeral 70 and shown in FIG. 3.

What has been shown is a convenient, highly specialized tint bottle and nozzle cleaning brush configured for use in the highly specialized environment of a hairstyling salon or the like in which tint bottles of the type described above and well known in the art are frequently used. The bottle brush provided utilizes a single handle having oppositely extending primary and secondary wire stems supporting highly specialized primary and secondary bristle arrays for use in cleaning both the tint bottle and nozzle cap portions of a conventional tint bottle. The opposed wire stem array maintains the ultimate in convenience and safety while maintaining easy access and availability of the primary and secondary bristle arrays.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in cleaning a tint bottle having a generally cylindrical bottle and a tapered nozzle cap, a tint bottle brush comprising:

an elongated handle defining an elongated handle body having a major axis and opposed first and second ends;

a primary wire stem secured to said first end and extending outwardly therefrom in alignment with said handle major axis and having a first outer end;

a primary bristle array supported by said primary wire stem forming a first generally cylindrical bristle portion extending generally from said first end of said handle to said first outer end of said primary wire stem and a generally domed outer portion at said first outer end;

a secondary wire stem secured to said second end and extending outwardly therefrom in alignment with said handle major axis and having a second outer end; and a secondary bristle array supported by said secondary wire stem forming a second generally cylindrical bristle portion proximate said second end defining a diameter and a tapered generally conical portion extending beyond said second generally cylindrical bristle portion having a maximum diameter proximate said second cylindrical bristle portion substantially less than said diameter of said second cylindrical portion and a minimum diameter at said second outer end.

2. A tint bottle brush as set forth in claim 1 wherein said elongated handle is generally cylindrical.

3. A tint bottle brush as set forth in claim 2 wherein said elongated handle defines a gently curved S-shaped silhouette.

4. A tint bottle brush as set forth in claim 3 wherein said primary bristle array defines a length and width generally corresponding to said generally cylindrical tint bottle.

5. A tint bottle brush as set forth in claim 1 wherein said primary bristle array defines a length and width generally corresponding to said generally cylindrical tint bottle.

6. A tint bottle brush as set forth in claim 1 wherein said elongated handle is generally cylindrical.

7. A tint bottle brush as set forth in claim 6 wherein said elongated handle defines a gently curved S-shaped silhouette.

* * * * *